United States Patent [19]

Manzonelli et al.

[11] 4,407,679

[45] Oct. 4, 1983

[54] METHOD OF PRODUCING HIGH TENSILE ALUMINUM-MAGNESIUM ALLOY SHEET AND THE PRODUCTS SO OBTAINED

[75] Inventors: Carmen C. Manzonelli, Corapolis, Pa.; David A. Chatfield, Michigan City, Ind.

[73] Assignee: National Steel Corporation, Pittsburgh, Pa.

[21] Appl. No.: 208,485

[22] Filed: Nov. 19, 1980

[51] Int. Cl.[3] ..... C22F 1/04

[52] U.S. Cl. ..... 148/2; 148/11.5 A; 148/439; 148/440

[58] Field of Search ..... 148/2, 11.5 A, 32

[56] References Cited

U.S. PATENT DOCUMENTS

| | | | |
|---|---|---|---|
| 2,790,216 | 4/1957 | Hunter | 22/57.5 |
| 3,397,044 | 8/1968 | Bylund | 29/183 |
| 3,490,955 | 1/1970 | Winter et al. | 148/11.5 |
| 3,571,910 | 3/1971 | Bylund | 29/527.7 |
| 3,615,371 | 10/1971 | Nakajima et al. | 75/147 |
| 3,763,686 | 10/1973 | Besel et al. | 72/364 |
| 3,770,515 | 11/1973 | Besel | 148/11.5 |
| 3,834,900 | 9/1974 | Klein | 75/142 |
| 3,967,983 | 7/1976 | Chia et al. | 148/2 |
| 4,111,721 | 9/1978 | Hitchler et al. | 148/2 |

*Primary Examiner*—R. Dean

*Attorney, Agent, or Firm*—Paul T. O'Neil

[57] ABSTRACT

A method of producing high tensile aluminum-magnesium alloy sheet from an aluminum-based melt containing a relatively low percentage of magnesium, such as 1.5-2.3%, in which the melt is formed into a sheet having a uniform thickness between $\frac{1}{8}$–$\frac{1}{2}$ inch quenched to a temperature below about 500° F. within a period of not more than three (3) minutes, in which the quenched sheet is cold rolled straight down to a thickness between 0.01 and 0.02 inch without the application of extraneous heat to the sheet. The resulting aluminum-magnesium alloy sheet has a fully-hardened tensile strength in excess of 50,000 psi.

16 Claims, No Drawings

METHOD OF PRODUCING HIGH TENSILE ALUMINUM-MAGNESIUM ALLOY SHEET AND THE PRODUCTS SO OBTAINED

BACKGROUND OF THE INVENTION

This invention relates to a process for producing a high tensile strength, light gage sheet from an aluminum-magnesium alloy containing a relatively low percentage of magnesium, i.e., between about 1.5 to about 2.3% by weight; the light gage sheet having a strength in excess of 50,000 psi when in a fully-hardened condition.

In general, aluminum-based alloys have found acceptance in the marketplace because of their light weight and relatively low cost. However, at least the latter attribute has been difficult, if not impossible, to achieve in a high-strength aluminum-based material. Aluminum-magnesium alloys have been used to satisfy strength requirements; however, the strength requirement of 50,000 to 60,000 psi for certain products, such as rigid containers and end covers for rigid containers made of aluminum, aluminum alloy, steel or other material, as well as products having similar strength requirements, are obtainable with an aluminum-magnesium alloy containing 5% by weight of magnesium which not only raised the cost of the product but presented more difficulties in casting and producing light gage material.

In an attempt to more efficiently make such high strength aluminum-magnesium alloy material, continuous strip casting was tried but it became apparent that aluminum alloy containing a high percentage, i.e., about 5% by weight, of magnesium could not be continuously cast at commercially acceptable speeds. Furthermore, prior processes involving continuous casting of an alloy having a magnesium content of about 2% require a full or partial anneal before cold rolling and/or one or more intermediate annealing steps during cold rolling that precipitate some of the dissolved constituents and soften the metal for ease in subsequent cold working. Consequently, the highest possible strength of the resulting product, consistent with desired quality, has been between about 45,000 to 46,000 psi in the full hard condition. Furthermore, conventional practice for producing a sheet of 5051 alloy, containing about 1.9 magnesium, with a temper of H19 involves a heat treatment at about 675° F. for a period of two hours at 0.07 gage in order to obtain a strength of about 41,000 psi, maximum.

Pursuant to the present invention, a process is provided for producing a cold reduced, high tensile strength, aluminum-magnesium alloy sheet from a low magnesium content starting composition having a yield and full-hardened tensile strength as high as 50,000 psi to about 60,000 psi which is the strength of products produced from high magnesium content aluminum-magnesium alloys in accordance with conventional practices.

SUMMARY OF THE INVENTION

According to the present invention, high tensile aluminum-magnesium alloy sheet is produced by providing a melt comprising 0.15–0.45% silicon, 0.10–0.90% iron, 1.5–2.3% magnesium, and the remainder aluminum, along with small amounts of alloying agents which do not adversely affect the physical characteristics of the product; by forming from the melt a sheet of aluminum-magnesium alloy having a uniform thickness between 0.125 and 0.5 inch; by providing the aluminum-magnesium alloy sheet rapidly quenched to a temperature below about 500° F. within a period of not more than three (3) minutes to obtain a metallurgical structure in which the alloying constituents are in solid solution, and by cold rolling the quenched aluminum-magnesium alloy sheet straight down to a thickness between 0.01 and 0.02 inch without the application of extraneous heat to the sheet, whereby an aluminum-magnesium alloy sheet having a full-hardened tensile strength in excess of 50,000 psi is produced. For certain use, such as forming end covers for rigid containers, the sheet material produced according to the above method is first stress-relieve annealed to reduce its tensile strength to about 42,000 psi and then formed according to conventional techniques so that the original high tensile strength in excess of 50,000 psi is restored to the formed portions of the product.

DETAILED DESCRIPTION OF THE INVENTION

The present invention is based on the discovery that by providing an aluminum-based alloy melt containing between about 1.5 to about 2.3% magnesium in the melt; by continuously forming a sheet from the melt; by providing the formed sheet quenched to a temperature below about 500° F. within a period of less than three (3) minutes, and by cold rolling the quenched sheet straight down to a reduction of between about 80 to 95% without application of extraneous heat, a product is produced which has commercially acceptable ductility and a full hardened tensile strength in excess of 50,000 psi, usually 50,000 to about 60,000 psi.

A satisfactory melt of aluminum-magnesium alloy for use in practicing the present invention has a composition of between about 1.5 to about 2.3% magnesium, 0.15 to 0.45% silicon, 0.10 to 0.90% iron with the remainder being aluminum and small amounts of alloying agents which will not adversely affect the physical characteristics of the product. Included in the present concept of such a melt are registered alloy compositions such as 5051 and 5151. A preferred composition comprises the following weight percentages of the constituents: 1.5–2.1 Mg, up to 0.2 Si, 0.1–0.5 Fe, 0.1–0.2 Mn, up to 0.1 Cu, up to 0.1 Cr, up to 0.15 An, 0.001–0.1 Ti, and the remainder aluminum. In accordance with the present invention, an intermediate sheet, of a thickness of about $\frac{1}{8}$–$\frac{1}{4}$ inch, is formed from the aluminum-magnesium alloy melt and critically quenched so that the majority of the constituents of the alloy are maintained in solution. In particular, the solidified alloy is rapidly quenched to reduce its temperature to below 500° F. within a period of less than three (3) minutes; the quenching occurring in part during formation of the sheet. Thereafter, the quenched sheet is cold reduced straight down to a reduction of between 80–95% without any intermediate anneal or application of any extraneous heat to the sheet.

In carrying out the process of this invention a sheet may be formed from the aluminum-magnesium melt by using a continuous caster apparatus such as the Hunter-type which is disclosed in U.S. Pat. No. 2,790,216. In that apparatus, the cast strip aluminum or aluminum alloy issues vertically from between water-cooled caster rolls which makes possible rapid cooling from an as-cast temperature above 600° F. down to a temperature of 500° F. or less in about three (3) minutes to effect keeping the majority of the constituents of the alloy in solution in accordance with the teachings of the present invention. While a Hunter-type caster is particularly preferred, the present invention is not so limited as other types of continuous casting apparatus may be used. Also, the sheet may be obtained by hot rolling an ingot produced by a direct chilled casting apparatus. For example, a melt of aluminum-magnesium alloy having about 1.5–2.3% magnesium, may be cast as an ingot about twenty inches thick by a direct chilled casting process and then hot rolled to form a sheet ⅛–½ inch thick. During hot rolling the sheet is cooled to less than about 500° F. within a period no greater than three (3) minutes and the cooled sheet is then cold-rolled in steps straight down to a gage representing an 80–95% reduction in thickness without application of extraneous heat.

In a typical process embodying the present invention using a Hunter-type caster, the molten metal is alloyed in a melting furnace, then transferred to a holding furnace where temperature is closely controlled between about 1270°–1275° F. From the holding furnace the melt flows through a tapout box and then to a head box which maintains proper metal level. A portion of the melt then passes to a distributor box which spreads it into a Marinite feed tip assembly which is positioned just behind the "bite" of a pair of large, water-cooled casting rolls. The metal freezes into solid strip just before it reaches the centerline of the rolls and is subjected to hot work as it passes between them. The casting speed when processing a 5051 type aluminum alloy, for example, may be about 28 inches per minute. A fine-grained reroll sheet emerging from the rolls has a thickness of about ⅛–½ inch and is quenched to a temperature of 500° F. in about three (3) minutes. The quenched ⅛–½ inch thick sheet is then cold-rolled in steps straight down to a gage representing an 80–95% reduction in thickness. For example, ⅛ inch strip will be cold rolled to a thickness between 0.006–0.019 inch, preferably 0.0125 inch, and a ½ inch thick sheet would be cold rolled at 0.0125–0.037 inch, preferably 0.025 inch. The aluminum alloy sheet product so obtained will have a yield and tensile strength in excess of 50,000 psi and a ductility of about 1% in 2 inches.

The product produced according to this invention may be utilized as end cover stock for three-piece containers as well as two-piece containers formed by a D&I operation. When utilized for that purpose, the stock must first be stress-relieve annealed without recrystallization to reduce the tensile strength down to about 42,000 psi, and then worked according to standard shaping operations. The important factor is that the cover stock or sheet formed from an aluminum based alloy containing less than 2% magnesium, e.g. 1.8% by weight, when produced according to the present invention and when subjected to conventional shaping operations, will produce container end covers having a work-hardened tensile strength approaching 60,000 psi. By way of contrast, a sheet of 5052 type alloy containing 2.5% magnesium, not subject to the rapid cooling and subsequent cold working in accordance with the present invention, cannot achieve a tensile strength anywhere near 60,000 psi in a fully hardened condition.

The following examples will further illustrate the invention:

EXAMPLE I

An aluminum-magnesium alloy melt having the following composition, by weight percent: Mg 1.9; Fe 0.83; Si 0.38; Mn 0.22; Cu 0.15; Zr 0.22; Ti 0.17; Cr 0.05 and the remainder aluminum, essentially alloy 5051, was continuously strip cast in a Hunter type caster to per gage of ¼ inch. The casting speed was about 28 inches a minute. The quenching rate from the melt temperature down to below 500° F. was as indicated by the following temperatures of the strip at the indicated distances in feet from the caster rolls: one foot, 600° F.; two feet, 570° F.; three feet, 560° F.; four feet, 550° F.; five feet, 540° F.; six feet, 525° F.; seven feet, 520° F.; eight feet, 515° F.; nine feet, 500° F., ten feet, 490° F. The recoiled strip at a temperature below 500° F. was cold rolled in a plurality of reduction steps from the 0.250 inch thickness to 0.040 inch thickness, the percent cold reduction in this part of the method being 84%. The yield strength of the strip at this point was 49,500 psi. The strip was next cold reduced from 0.040 to 0.024 inch, a cumulative cold reduction of 90% from the 0.25 inch thickness. The yield strength of the strip at this point was 54,400. Cold rolling further to 0.013 inch, or about 95% reduction, the yield strength was 57,000 psi and the tensile strength was 59.000 psi.

EXAMPLE II

Utilizing a continuous casting process essentially the same as described in Example I, to process a 5151 type aluminum-based alloy will result in a product having a full-hardened yield and tensile strength in excess of 50,000 psi. The elements of such a 5151 type composition are present in the following weight percentages: 1.5 Mg, 0.4 Si, 0.7 Fe, 0.20 Mn, 0.25 Cu, 0.25 Zn, up to 0.1 Cr, 0.10 Tr, and the remainder aluminum.

EXAMPLE III

An aluminum-magnesium alloy melt having the following composition: Mg 1.9; Fe 0.83; Si 0.38; Mn 0.22; Cu 0.15; Zr 0.22, Ti 0.17; Cr 0.05 and the remainder aluminum, essentially alloy 5051, is cast as an ingot about twenty (20) inches thick by a direct chilled casting process and the ingot is hot rolled to form a sheet 0.25 inch thick. The sheet enters the hot mill at about 850° F. and is rapidly quenched during and/or immediately after the hot rolling to cool the sheet to below 500° F. within a period of less than three (3) minutes. The quenched strip at a temperature below 500° F. is cold rolled in a plurality of reduction steps to 0.024 inch, a cumulative cold reduction of 90% from the 0.25 inch thickness. The yield strength of the strip at this point is 53,000 psi.

Contrary to the teachings of the prior art to the effect that cold rolling a low content aluminum-magnesium alloy produced by continuous strip casting will result in edge cracking and poor shape without heat treatment during cold rolling, there does not appear to be any difference in edge cracking severity between the samples rolled in accordance with the present invention and samples rolled down to the same thickness where the samples have been recrystallized during intermediate anneal at 0.090 inch thickness.

Thus, products of this invention do not have objectionable edge cracking and have commercially acceptable shape. While not intending to be bound by this theory, it is believed that the surprising high tensile strength of the products of this invention result from the as-cast strip having the important strengthening constituents still in solution throughout the cold rolling process.

It should be understood that this invention may be embodied in other specific forms without departing from its spirit or essential characteristics. Accordingly, the present embodiments are to be considered in all respects as illustrative and not restrictive, the scope of the invention being defined by the appended claims rather than by the foregoing description, and all changes which come within the meaning and range of equivalency of the claims are intended to be embraced therein.

What is claimed is:

1. The method of making a high tensile aluminum-magnesium alloy sheet product comprising forming an aluminum-magnesium alloy melt consisting essentially of 0.15–0.45% silicon, 0.10–0.90% iron, 1.5–2.3% magnesium and the remainder aluminum, continuously forming from the melt a sheet of aluminum-magnesium alloy having a uniform thickness between 0.125 and 0.5 inch, providing the aluminum-magnesium alloy sheet quenched to a temperature below 500° F., the quenching taking place in not more than about three minutes, and cold reducing the quenched sheet straight down to an 80%–95% reduction in thickness without the application of extraneous heat to the sheet, to thereby obtain an aluminum-magnesium alloy sheet product having a yield and tensile strength in excess of 50,000 psi.

2. The method of making a high tensile aluminum-magnesium alloy sheet product comprising forming an aluminum-magnesium alloy melt consisting essentially of 0.15–0.45% silicon, 0.10–0.90% iron, 1.5–2.3% magnesium and the remainder aluminum, continuously casting from the melt a sheet of aluminum-magnesium alloy having a uniform thickness between 0.125 and 0.5 inch, quenching the aluminum-magnesium alloy sheet as it is cast from the temperature of the melt to a temperature below 500° F., the quenching taking place in not more than about three minutes, and cold-reducing the as-cast and quenched sheet straight down to an 80%–95% reduction in thickness without the application of extraneous heat to the sheet, to thereby obtain an aluminum-magnesium alloy sheet product having a yield and tensile strength in excess of 50,000 psi.

3. The method according to claim 2 wherein the as-cast sheet has a thickness of 0.125 inch and is cold rolled straight down to a thickness of 0.006–0.019 inch.

4. The method according to claim 3 wherein the as-cast sheet is cold rolled to a thickness of 0.0125 inch.

5. The method according to claim 2 wherein the as-cast sheet has a thickness of 0.5 inch and is cold rolled straight down to a thickness of 0.0125–0.035 inch.

6. The method according to claim 5 wherein the as-cast sheet is cold rolled to a thickness of 0.025 inch.

7. The method according to claims 1, 2, 3, 4, 5 or 6 wherein the alloy melt comprises a 5051 aluminum-based alloy.

8. The method according to claims 1, 2, 3, 4, 5 or 6 wherein the alloy melt comprises a 5151 aluminum-based alloy.

9. The method according to claims 1, 2, 3, 4, 5 or 6 wherein the alloy melt comprises 1.5–2.1 Mg, up to 0.2 Si, 0.1–0.5 Fe, 0.1–0.2 Mn, up to 0.1 Cu, up to 0.1 Cr, up to 0.15 Zn, 0.001–0.1 Ti, and the remainder aluminum.

10. The method according to claims 1, 2, 3, 4, or 5 and further comprising the steps of stress-relieve annealing the cold rolled aluminum-magnesium alloy sheet, subjecting the stress relieved product to a forming procedure, and recovering a product having a work-hardened tensile strength in excess of 50,000 psi.

11. The product produced according to claim 1.

12. The product produced according to claim 2.

13. The product produced according to claim 7.

14. The product produced according to claim 8.

15. The product produced according to claim 9.

16. The product produced according to claim 10.

* * * * *